US007669935B2

(12) United States Patent
Crossley et al.

(10) Patent No.: US 7,669,935 B2
(45) Date of Patent: Mar. 2, 2010

(54) PROTECTIVE CHAIR

(76) Inventors: Michael John Crossley, Dunstans, Shermanbury Road, Partridge Green, Horsham, West Sussex (GB) RG13 8EU; Kenneth Holt, 90 Tollers Lane, Coulsdon, Surrey (GB) CR5 1BB ( * ) Notice: Subject to any disclaimer, the term of this patent is extended or adjusted under 35 U.S.C. 154(b) by 0 days.

(21) Appl. No.: 11/273,592

(22) Filed: Nov. 14, 2005

(65) Prior Publication Data

US 2007/0108807 A1 May 17, 2007

(51) Int. Cl.
*A47C 7/02* (2006.01)
*A47C 7/54* (2006.01)

(52) U.S. Cl. ..... 297/452.36; 297/452.37; 297/452.31; 297/411.2

(58) Field of Classification Search ..... 89/36.11, 89/36.02, 36.01, 36.04; 297/216.13, 216.1, 297/411.2, 452.24, 452.25, 184.14, 256.15, 297/487, 216.14, 452.18, 184.1, 452.36, 297/411.37, 411.38, 467, 452.31, 217.1, 297/158.1, 217.5, DIG. 1, 452.37, 452.65, 297/216.4, 217, 344.22, 423.19, 423.17, 297/423.26, 116–117, 411.31–411.34, 488, 297/423.3, 423.28; D6/421, 334; 248/501
See application file for complete search history.

(56) References Cited

U.S. PATENT DOCUMENTS 126,485 A * 5/1872 Phillips et al. ..... 248/405
2,858,876 A * 11/1958 Woodson, Jr. ..... 297/353
2,970,638 A * 2/1961 Halter ..... 297/452.25
3,087,757 A * 4/1963 Hyman ..... 297/423.28
3,133,765 A * 5/1964 Kramer ..... 297/446.1
3,165,355 A * 1/1965 Hitchcock, Jr. et al. .. 297/216.1
3,740,096 A * 6/1973 Bridger ..... 297/452.25
3,762,767 A * 10/1973 Powell ..... 297/217.5
3,848,921 A * 11/1974 Rhodes ..... 297/184.1
4,285,544 A * 8/1981 Zapf ..... 297/440.21
4,385,783 A * 5/1983 Stephens ..... 297/452.55
4,705,256 A * 11/1987 Hofrichter ..... 248/418
5,015,038 A * 5/1991 Mrotz, III ..... 297/452.15
5,039,162 A * 8/1991 Yoshida ..... 297/216.1
5,085,447 A * 2/1992 Audibert ..... 280/30
5,164,536 A * 11/1992 Barbaza et al. ..... 89/36.11
5,180,880 A * 1/1993 Zufle ..... 89/36.02
5,380,065 A * 1/1995 Rohrer ..... 297/411.37
5,448,938 A * 9/1995 Fernandez et al. ..... 89/36.02
5,755,490 A * 5/1998 Lamart ..... 297/353
5,791,761 A * 8/1998 Bryant et al. ..... 362/131
5,954,307 A * 9/1999 Williams ..... 248/501
6,073,884 A * 6/2000 Lavergne ..... 244/122 R (Continued)

FOREIGN PATENT DOCUMENTS

DE 1283461 11/1968

(Continued)

OTHER PUBLICATIONS

Invitation to Pay Additional Fee and Partial International Search Report mailed Jun. 10, 2008.

*Primary Examiner*—Milton Nelson, Jr.
(74) *Attorney, Agent, or Firm*—Carlson, Gaskey & Olds

(57) ABSTRACT

There is provided a chair capable of providing protection to an occupant in the event of an explosion. The chair may provide a protective "cocoon" for an occupant and may intercept projectiles such as debris, fragments and glass shards. The chair may also reduce blast over-pressure acting on an occupant's ears, reduce shock levels acting on an occupant's lungs and provide protection against an occupant being unseated by an explosion.

5 Claims, 16 Drawing Sheets

U.S. PATENT DOCUMENTS

| | | | | | |
|---|---|---|---|---|---|
| 6,158,808 | A | * | 12/2000 | Margolis et al. | 297/330 |
| 6,164,181 | A | * | 12/2000 | Bruner | 89/36.02 |
| 6,257,237 | B1 | * | 7/2001 | Suzuki | 128/846 |
| 6,305,744 | B1 | | 10/2001 | Martin | |
| 6,688,554 | B2 | * | 2/2004 | Weekly | 244/118.5 |
| 6,688,686 | B1 | * | 2/2004 | McEvoy et al. | 297/284.4 |
| 7,040,708 | B2 | * | 5/2006 | Black | 297/452.34 |

FOREIGN PATENT DOCUMENTS

| | | | |
|---|---|---|---|
| DE | 3544402 | | 9/1986 |
| FR | 1261823 | | 5/1961 |
| FR | 2285259 | | 4/1976 |
| GB | 2277869 | A * | 11/1994 |
| WO | WO 8103114 | A * | 11/1981 |

* cited by examiner

PROTECTIVE CHAIR

FIELD OF THE INVENTION

The present invention relates to a chair providing protection to an occupant in the event of an explosion. The explosion may be any type of explosive event such as an intended terrorist bomb blast or an unintended explosive event such as an accidental explosion at a refinery.

BACKGROUND OF THE INVENTION

Persons located behind glazing units, such as office workers in buildings with an outer glass structure, are vulnerable to the effects of a bomb blast. Bomb blasts may result in injuries or fatalities.

Persons may be killed with fragments from a bomb casing or the body of a car containing such a bomb. Material in close contact with explosive material from, for example, a terrorist vehicle bomb, will travel at very high velocity, and in many cases, the resulting fragments may be travelling at a speed greater than a bullet. A person hit with such a fragment from a bomb casing or a body of a car, is therefore being hit with fragments with the similar effect to that of a large bullet. Clearly, this results in serious injury or fatality.

On activation of a bomb, debris may also be formed from the resulting break-up of a car filled with explosive material. Debris may result from the break-up of a car body and engine etc. Generally, the velocity of such debris is much lower than the previously described fragments. However, the mass of such debris is generally greater than that of fragments, rendering the formed debris extremely dangerous. The debris can therefore result in serious injury or fatality.

A bomb blast may also result in eardrum rupture of persons in close proximity to a bomb. Blast over-pressure resulting from an explosion may cause eardrums to rupture, resulting in permanent loss of hearing.

A bomb blast may also result in lung damage, as when a person is hit by blast over-pressure, a shockwave travels through a person's body. If the shockwave is of sufficient intensity, this can rupture blood vessels in the lungs, resulting in serious injury or more likely fatality due to inability to breath. The blast pressure required to cause lung damage is generally greater than that needed to cause eardrum rupture.

A bomb blast may also result in persons being thrown around. This may also lead to injuries which may be fatal.

A further major hazard with bomb blasts, is that caused by glass in glazing units. This is of great concern in many office blocks which have an outer structure mainly formed of glass or have significant areas of glass. The resulting blast over-pressure from an explosion may cause the shattering of glazing, resulting in the projection of lethal glass shards. The glass shards can be projected at speeds up to or even greater than 100 meters per second (i.e. over 200 miles per hour). Glass shards are considered potentially lethal at speeds of over 9 meters per second (i.e. 20 miles per hour). At lesser speeds persons may suffer moderate or serious injuries. It has been found that most injuries from a bomb blast targeted at an office block, will be caused by glass shards. In a bomb blast situation, glass is projected from a window primarily perpendicular to the plane of the window i.e. with very little spread regardless of bomb location. Glazing fragments will initially take a primarily horizontal path, thereafter falling due to gravity. This results in the lethal nature of the glass shards.

Secondary debris may also be generated by the bomb explosion. The secondary debris may be formed by dislodged/projected items moved by the effects of the explosion.

Secondary debris can cause serious injury to occupants of a building. Secondary debris may be formed from suspended ceiling tiles (dislodged by the blast and falling due to gravity), light fittings, lightweight stud partitions, furniture, masonry partitions and non-glazed external cladding.

A bomb blast may also result in the complete structural collapse of a building. In the event that a structure collapses, occupants within such a structure may be crushed to death.

Although a number of protective chairs exist such as described in U.S. Pat. Nos. 5,164,536, 5,448,938, 6,164,181, 6,688,554, FR 2803256, and JP 2005,043030, which are incorporated herein by reference, none of these chairs relate to protecting an occupant in the event of a bomb blast.

The present invention provides a cost effective way of protecting an occupant of a building exposed to a bomb attack. Although toughened glass and laminated glass have previously been used to protect occupants from bomb blast, these types of glasses are expensive thereby substantially increasing the cost of construction. Moreover, although locating protective films over annealed and toughened glass may also be considered, using such types of glass films create their own problems. For example, protective films suffer from the following disadvantages: limited protection; limited design life; difficult to install to obtain full benefits; need for special measures to prevent damage and deterioration due to cleaning; easily damaged detracting from the films aesthetic qualities; and expense. Additionally, such types of films can cause a whole glass pane to be blasted into a room which is highly dangerous. Toughened glass also tends to break into large blocks, which are extremely dangerous. Moreover, energy resulting from a bomb blast which is transmitted to glass, will as a result of filming be transmitted to a building possibly resulting in catastrophic failure of the building.

It is an object of at least one aspect of the present invention to obviate or mitigate at least one or more of the aforementioned problems.

It is a further object of at least one aspect of the present invention to provide a chair which assists in the protection of an occupant so that the probability of a person surviving a bomb blast or similar explosive event is increased.

It is a further object of at least one aspect of the present invention to provide a chair which is capable of protecting surrounding workers in an office environment when a bomb explodes.

SUMMARY OF THE INVENTION

According to a first aspect of the present invention there is provided a chair capable of providing protection to an occupant in the event of an explosion, said chair adapted to minimize blast pressure acting on a back of said chair.

The explosion may be any type of explosive event such as an intended terrorist bomb blast or an unintended explosive event including that of an accidental explosion at a refinery.

The chair may be adapted to significantly reduce the risk of injury or fatality to persons working in an office environment from the effects of a bomb blast. The bomb blast may result from a terrorist explosive device such as a car, van and truck bomb, as well as suicide and package bombs. The chair according to the present invention may also reduce the risk of injury from military weapons often obtained and used by terrorists. Examples include mortars, hand grenades and guns.

The chair may be designed primarily for use by persons located on a periphery of a building and, in particular, for persons located adjacent to external glazing. The chair may also be designed to be located adjacent to internal glazing of a building.

The chair may provide a protective "cocoon" for a person sitting on the chair. Although the chair according to the present invention has the function of protecting an occupant during an explosion, the chair may be used for its standard and normal function i.e. a chair.

The chair may intercept projectiles, such as debris, fragments and glass shards, reduce blast over-pressure acting on an occupant's ears, reduce shock levels acting on an occupant's lungs and provide protection against an occupant being thrown around. The chair may also comprise an anti-ricochet layer which may help to minimize the ricochet of projectiles towards office workers that may be located further within an office.

The chair may also act as a 'shadow' by protecting persons located behind the chair. By forming a 'shadow' is meant that due to the trajectory of debris and fragments, the chair provides protection greater than the cross-sectional area of the chair. For example, a chair with a width of 0.8 m may provide a protective 'shadow' with a width of about 1.0 m.

The chair according to the present invention may therefore provide the following features:

- protection against glass shards, fragments and debris;
- reduce blast pressures;
- reduce shock;
- reduce the possibility of a person being thrown around i.e. body translation;
- form a 'shadow' to protect persons located behind the chair in a building or office; and
- conceal an occupant from each side to thereby minimize risk of an orchestrated attack on an individual e.g. a sniper attack.

It is intended that chairs according to the present invention may be used in banks, commercial activities, financial institutions, government institutions, embassies, major transport hubs such as airports, airport canteens and reception areas, military installations, United Nations buildings, chemical manufacturing facilities, petrochemical related buildings such as refineries, and drug companies including those involved in animal testing. The chairs may also be used by military personnel if they are working in an office type environment and not in an armored car or tank, aircraft, etc.

The chair may comprise a frame, said frame comprising a spine-like rigid structure extending down the back of the chair. The spine-like rigid structure may extend substantially down all or at least part of the back of the chair. The spine-like rigid structure may be constructed from a strong material with preferably a high tensile strength. For example, any suitable metal, alloy, plastics or composite material may be used. The spine-like structure may have the function of providing added protection to an occupant's spine and head.

The spine-like rigid structure may also provide added strength to the chair and may help to prevent the chair losing structural integrity in the event of an explosion such as a bomb blast.

The spine-like rigid structure may also be designed to spread the weight of the chair and cushion the impact of an occupant in the event that the chair overturns due to extreme bomb blast pressure. The spine-like structure may therefore help to minimize injury to an occupant in the event that the chair overturns.

The spine-like rigid structure may be shaped to promote reduction of blast over-pressure acting on the back of the chair and thus minimize the likelihood of the chair overturning. For example, the spine-like rigid structure may be substantially curved in shape along the length of the structure.

The spine-like structure may also comprise an extended lower section in the form of a tail which may provide protection against glass shards or debris to a lower part of an occupant's body such as the legs.

The back of the chair may be formed from a shell-like structure. The shell may have an outer curved surface, substantially convex in shape, which may reduce blast pressure. For example, blast pressures may be transmitted to the sides or base of the chair. The back of the chair may be designed to split the blast force resulting from an explosion. The back of the chair may also help to reduce blast over-pressure on a seated occupant's body and ears and hence reduce the risk of lung damage and ear injury.

Extending down the back of the chair there may be a protruding ridge. The ridge may form a substantially 'V'-shaped member extending out from the back of the chair. The ridge may be substantially centrally located on the back of the chair, to thereby substantially split blast pressure. The ridge may therefore be designed to promote reduced blast pressures acting on the chair, and minimize the likelihood of the chair overturning.

The ridge may protrude out from the back of the chair by about 0.5 to 20 cm, about 1 to 10 cm, about 1 to 5 cm, or about 2, 3, 4 or 5 cm. The ridge may protrude out from the back of the chair by a substantially constant amount.

The spine-like rigid structure may be located substantially behind the ridge.

The ridge may be integrally formed in the shell forming the back of the chair or may be a separate member which may be attached via any suitable means such as a simple screw attachment, adhesive means or Velcro(Trade Mark).

The back of the chair may also be adapted so that it may be attached in a retro-fit manner to existing chairs.

The shell forming the back of the chair may be adapted and designed to act as a barrier against debris and fragments etc. created from a bomb blast. The shell may be about 1-20 cm or preferably about 10 cm thick. An outer surface of the shell may be formed from strong material such as any suitable metal, alloy, plastics or composite material. The outer surface of the shell which may form the back of the chair may be resilient and semi-deformable thereby preventing debris and fragments ricocheting off the back of the chair and injuring nearby persons. Suitable materials may be Kevlar(Trade Mark); polymeric plastics; composite materials; fibreglass; glass reinforced plastic; carbon fibre; steel; aluminum; metal alloys; timber including laminated timber; timber based products; particle boards; ceramic and ceramic compounds; complex composites; carbon fibre reinforced plastic; and rubberized compounds. The outer surface of the shell may also have the ability to act as a barrier against bullets fired from a gun.

Behind the outer surface of the shell, there may be a foam region which may be formed from energy absorbing material, intended to absorb the energy from debris or fragments. Any suitable dense foam material may be used which has the facility to absorb energy from debris or fragments. The foam region may be about 1-20 cm or about 1-10 cm thick and may extend substantially down all the back of the chair. Suitable materials may be selected from any of the following: polyurethane; Evlon(Trade Mark); latex rubber foam; viscoelastic foam; closed cell foam; and fibre foam.

After the foam region, the shell may also comprise a multi-layered structure such as a sandwich-type structure. The multi-layered structure may comprise at least one or a plurality of alternating hard/soft layers. Alternating layers have been found to perform better than a single layer of the same overall thickness in acting as a barrier against debris or fragments. Suitable materials may be alternating layers of any of the following: polyurethane; Evlon(Trade Mark); latex rubber foam; viscoelastic foam; closed cell foam; fibre foam; Kevlar(Trade Mark); polymeric plastics, composite materials; fibreglass; glass reinforced plastic; carbon fibre; steel; aluminum; metal alloys; timber including laminated timber; timber based products; particle boards; ceramic and ceramic compounds; complex composites; carbon fibre reinforced plastic; and rubberized compound. Chair fabric may also be used to surround the multi-layered structure.

The alternating hard/soft layers may have different densities and may therefore reduce the shock loading acting on a seated occupant's lungs, thereby reducing the likelihood of injury/fatality.

The back of the chair may also comprise a soft cushioned area attached onto the shell forming the back of the chair. The cushioned area may be about 1-10 cm or about 1-5 cm thick. The soft cushioned area may be formed integrally onto the shell or may form a separate member which may then be attached to the shell via any suitable attachment means such as adhesive or using mechanical fasteners. The soft cushioned area provides comfort to a seated occupant. In the event of an extreme blast causing the chair to overturn, the cushioned area may soften the impact on a seated person. The cushioned area may also protect an occupant by absorbing energy from debris hitting the back of the chair, thereby increasing the likelihood of survivability.

The chair may also comprise a member in the form of a leg protective member, flap or skirt for protecting the legs of an occupant. The member providing protection for the legs of an occupant may extend downwards by, for example, about 20-50 cm from a seating area of the chair and may be located behind the legs of an occupant. The leg protective member may be strong enough to resist blast loadings and may be strong enough to protect legs against projectiles such as glass shards. The leg protective member may be hinged such as in the form of a cat flap, to absorb blast energy (energy will be used when pushing the leg protective member upwards i.e. against gravity and against a person's legs). The leg protective member may also be designed to engage with a floor in the event that the chair starts to topple over. An end of the leg protective member may therefore be adapted to be located just above a floor. The leg protective member may therefore provide further stability in the event that the chair experiences extreme blast pressure. The leg protective member may be constructed from any suitable material and may be single-layer, multi-layer or of a sandwich-type construction. Suitable materials may be any of the following: Kevlar(Trade Mark); polymeric plastics; composite materials; fibreglass; glass reinforced plastic; carbon fibre; steel; aluminum; metal alloys; timber including laminated timber; timber based products; particle boards; ceramic and ceramic compounds; complex composites; carbon fibre reinforced plastic; and rubberized compounds.

A perimeter profile of the chair may also be designed to have geometry to promote formation of vortices to facilitate the reduction of blast wave energy and thereby reduce pressure acting on an occupant and chair, and therefore reduce the likelihood of injury, particularly to the ears of an occupant.

The chair may also comprise means to restrict movement of the chair such as lockable castor wheels or rollers. Lockable rotation means may help to restrict the rotation of the chair thereby preventing a user from inadvertently rotating the chair to face a glazing unit which will substantially reduce the effectiveness of the bomb blast chair.

The chair may also be mounted on an energy absorption mechanism such as a leaf-spring or gas-spring structure which under normal conditions provides comfort for a user. During a bomb blast, the energy absorption mechanism may act in a similar fashion to shock absorbers thereby reducing the blast effects and minimizing an occupant being thrown about. The energy absorption mechanism may also minimize the possibility of the chair overturning during a bomb blast.

Typically, the chair according to the present invention may comprise supporting structures such as legs and struts of enhanced strength construction in order to transfer blast loading forces away from the chair.

A rear leg of the chair may also be provided with an anti-toppling device and/or anti-sliding device such as a protruding member intended to engage and/or attach with a floor and therefore help prevent blast forces from overturning the chair. The rear leg may therefore comprise a latch or an eyelet which may attach to a tie-line or hook located on a floor which may be used to secure the chair. In a blast event, a chair subjected to blast loading may slide horizontally and may also rotate about forward legs of the chair which may act as a fulcrum. Securing a rear leg of the chair to a floor or providing a member which engages with a floor in the event of sudden movement, may reduce the likelihood of the chair being moved horizontally or being rotated by a bomb blast.

A seating area of the chair may also comprise a raised surface which may be adapted to prevent an occupant from sliding out of the chair when the chair is subjected to bomb blast forces. The raised surface may be located towards a front portion of the seating area. The raised surface may therefore act as an anti-submarine bump retaining an occupant in place.

Armrests located on the chair may also comprise airbags which may inflate in the event of a bomb blast. The airbag mechanism may be activated either by pressure sensors in the back of the chair, or by sensors in the chair detecting sudden movement indicating that the chair may be about to be overturned by a bomb blast. The armrests may also comprise protecting members in the form of a series of fins or louvers which prevent debris and fragments contacting an occupant's lower body or legs. The fins or louvers may be formed from strong material such as any of the following: Kevlar(Trade Mark); polymeric plastics; composite materials; fibreglass; glass reinforced plastic; carbon fibre; steel; aluminium; metal alloys; timber including laminated timber; timber based products; particle boards; ceramic and ceramic compounds; complex composites; carbon fibre reinforced plastics; and rubberized compounds. The series or plurality of fins or louvers may form an interlocking structure and may also aid ventilation to an occupant. The series or plurality of fins or louvers may be attached to armrests or a seating area of the chair, or a combination thereof.

Armrests located on the chair may also be designed to prevent an occupant from being removed from the chair by a bomb blast. For example, the armrests may pivot and may therefore be pointed inwards once an occupant is sitting in the chair. The armrests may therefore be biased using a spring arrangement to point inwards and abut against an occupant's body. Alternatively, the armrests may comprise a raised portion which may engage with an occupant's arms in the event that a bomb blast starts to remove a seated occupant.

The chair may also comprise an upper member in the form of a canopy which may prevent an occupant from being injured from falling debris or projectiles such as glass shards. The upper member may extend substantially fully or at least partly over an occupant's head thereby providing additional protection. The upper member may be formed from a fine, very strong, mesh-like material capable of resisting glass shards etc. but also allowing some light through. The upper member may alternatively be formed from any suitable acrylic, Perspex(Trade Mark) or ceramic composite. The upper section of the chair may be held in position via any suitable means such as "horns" or handles attached to the shell forming the back of the chair.

The combination of chair body, armrests, fins or louvers, may provide similar blast and glass shard protection to the side of an occupant as that provided by the back of the chair. This is important if there is glass to more than one side of a chair e.g. in a corner of an office or when a chair is oriented at an angle to an area of glass.

The chair may also comprise a speaker feature or phone which may be used in an emergency scenario to call for help.

Moreover, the chair may also comprise a track ball/mouse, electronic notepad, keyboard, etc. to provide further usable features for the chair.

The chair may also comprise an alerting device such as a beacon to aid detection of the chair and occupant after a bomb blast. The beacon may be activated by a pressure sensor on the chair.

The chair may also comprise a storage compartment which may be used to store normal office material but may also be used to store devices for emergency situations such as a torch, drink, first aid kit etc.

According to a second aspect of the present invention there is provided a method of providing protection to an occupant of a chair in the event of an explosion, said chair capable of reducing blast pressure acting on a back of said chair.

The explosion may be any type of explosive event such as an intended terrorist bomb blast or an unintended explosive event including that of an accidental explosion at a refinery.

Typically, the chair may reduce blast pressures around the chair thereby protecting an occupant in the event of a bomb blast.

According to a third aspect of the present invention there is provided a back of a chair capable of being fitted to an existing chair to form a retro-fitted chair, said back of the chair being adapted to minimize blast pressure acting on the back of the retro-fitted chair.

Typically, the back of the chair may be as described in the first aspect wherein a ridge may extend down an outer surface of a shell forming the back of the chair. The ridge may split a blast force resulting from an explosion thereby protecting an occupant during a bomb blast.

The back of the chair may comprise a spine-like structure, a foam region intended to absorb energy from a bomb blast, a multi-layered structure comprising alternating hard/soft layers and a comfort zone comprising a padded layer for an occupant. The back of the chair may also comprise an extended lower section intended to intercept glass shards and debris. The extended lower section may therefore provide protection to an occupant's lower body and legs.

The outer surface of the back of the chair may be substantially convex in shape to facilitate airflow around the chair.

The back of the chair may therefore be retro-fitted to existing chairs allowing existing chairs to be economically adapted to provide protection for occupant's in the event of a bomb blast.

According to a fourth aspect of the present invention, there is provided a chair capable of providing protection to an occupant in the event of an explosion, said chair adapted to resist debris and/or glass shard penetration.

According to a fifth aspect of the present invention, there is provided a chair capable of providing protection to an occupant in the event of an explosion, said chair adapted to resist ricochet of debris and/or projectiles.

According to a sixth aspect of the present invention, there is provided a chair capable of providing protection to an occupant in the event of an explosion, said chair comprising a leg protective member providing protection to a seated occupant.

The leg protective member may also prevent the chair from overturning.

Typically, the leg protective member may be rotatably coupled or hinged to any part of the chair such as a seating surface of the chair and may prevent debris or fragments damaging the legs of a seated occupant. Alternatively, the leg protective member may be in the form of a skirt member.

According to a seventh aspect of the present invention, there is provided a chair capable of providing protection to an occupant in the event of an explosion, said chair comprising sides which are adapted to minimize blast pressure acting on a chair or occupant.

Preferably, the sides of the chair by minimizing the blast pressure formed by a bomb blast may provide protection for an occupant's ears and lungs and therefore reduce the possibility of injury or fatality.

According to an eighth aspect of the present invention, there is provided a chair capable of providing protection to an occupant in the event of an explosion, said chair comprising legs adapted to absorb at least some of the pressure or energy from an explosion.

Typically, the legs may be in the form of sprung legs such as gas spring mounted legs or leaf-spring mounted legs.

Rear legs may also comprise an anti-toppling device and/or anti-sliding device intended to attach or engage with a floor and therefore help prevent blast forces from overturning the chair. Securing a rear leg of the chair to a floor or providing a member which engages with a floor, may reduce the likelihood of the chair being moved horizontally or rotating in the event of an explosion According to a ninth aspect of the present invention, there is provided a chair capable of providing protection to an occupant in the event of an explosion, said chair comprising means of restricting the movement of the chair.

Typically, the means for restricting the movement of the chair may be lockable castors or lockable rollers.

The means for restricting the movement of the chair may prevent a user from inadvertently pointing the chair towards an outer glass surface of a building which substantially reduces the protection provided by the chair.

According to a tenth aspect of the present invention, there is provided a chair capable of providing protection to an occupant in the event of an explosion, said chair comprising means to prevent a seated occupant from being removed from the chair by an explosive event.

Typically, the means for preventing the occupant from being unseated from the chair in the event of a bomb blast may comprise a raised portion at a front of an area wherein an occupant is intended to sit. The means for preventing the occupant being moved by a bomb blast may therefore function as an anti-submarine bump. The means for preventing the movement of the occupant may be formed by adding additional cushioning to a seating surface of the chair.

Armrests located on the chair may also be designed to prevent an occupant from being removed from the chair by a bomb blast. Typically, the armrests may pivot and may therefore be pointed inwards once an occupant is sitting on the chair. The armrests may be biased using a spring arrangement to point inwards and abut against an occupant's body. Alternatively, the armrests may comprise a raised portion which may engage with an occupant's arms in the event that a bomb blast starts to remove a seated occupant.

According to an eleventh aspect of the present invention, there is provided a chair capable of providing protection to an occupant in the event of an explosion, said chair comprising airbags.

The airbags may be mounted in armrests located on the chair. The airbags may be activated by pressure sensors located in a back of the chair, or by sensors in a chair detecting sudden movement indicating that the chair may be about to be overturned by a bomb blast.

According to a twelfth aspect of the present invention, there is provided a chair capable of providing protection to an occupant in the event of an explosion, said chair comprising a canopy intended to extend over a seated occupant and thereby provide protection from glass shards and falling objects.

Typically, the canopy may form a shield protection extending over substantially all or at least partly over an occupant. The canopy may be formed from a fine, very strong, mesh-like material capable of resisting glass shards etc. but also allowing some light through. Alternatively, the canopy may be formed from any suitable acrylic, Perspex (Trade Mark) or ceramic composite. The canopy may be attached by any suitable means to a back of the chair.

The chair may also provide protection to a side of an occupant by the provision of armrests comprising fins or louvers, or by extending the canopy or a back of the chair at least partly around a side or both sides of the chair.

According to a thirteenth aspect of the present invention, there is provided a chair capable of providing protection to an occupant in the event of an explosion, said chair comprising a beacon thereby aiding detection of the chair and an occupant after an explosion.

Typically, the beacon may be activated by a pressure sensor on the chair.

According to a fourteenth aspect of the present invention, there is provided a chair capable of providing protection to an occupant in the event of an explosion, said chair comprising a first aid kit.

According to a fifteenth aspect of the present invention, there is provided a frame for a chair, said frame capable of providing protection to an occupant of a chair in the event of an explosion.

The frame may comprise a spine-like rigid member which may be adapted to minimize blast pressure acting on a back of the chair. The spine-like rigid member may also comprise a tail member which provides additional protection to an occupant of a chair.

BRIEF DESCRIPTION OF THE DRAWINGS

Embodiments of the present invention will now be described, by way of example only, with reference to the accompanying drawings.

DETAILED DESCRIPTION

Figure 1:
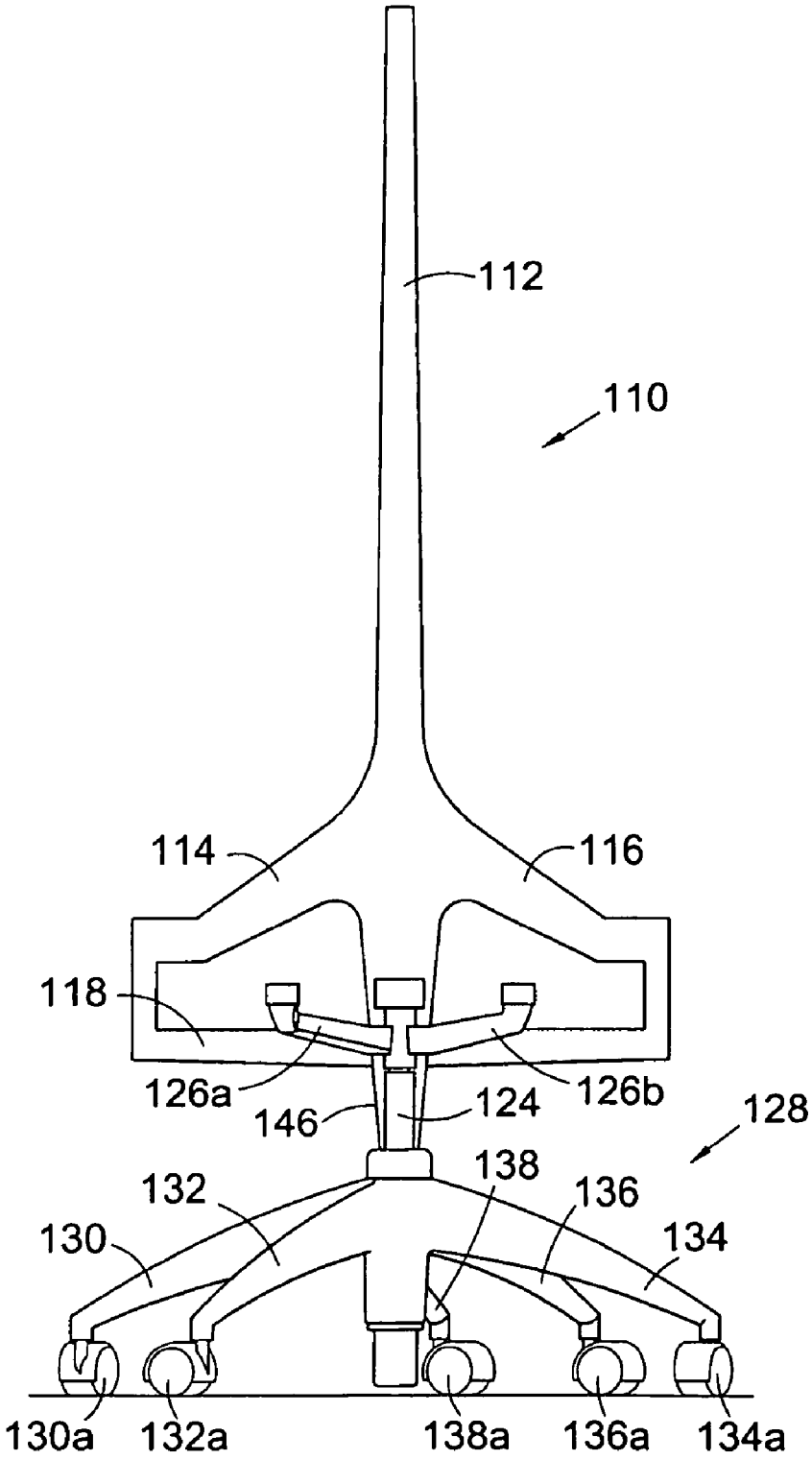
FIG. 1 is a front view of a frame for a chair according to a first embodiment of the present invention.

Referring to FIGS. 1 to 4, there is shown a frame, generally designed 110. The frame 110 comprises a substantially vertical spine 112 which is intended to provide strength to a chair. The spine 112 also provides protection to an occupant's spinal chord and head in the event of an explosion such as a bomb blast. Below the spine 112 there are two side members 114, 116 interconnected with a lower substantially horizontal member 118. The members 114,116,118 provide additional strength to a chair.

The frame 110 is connected via a coiled spring 120 and arm 122 to a gas-sprung piston 124. The gas-sprung piston 124 provides added comfort for an occupant and may absorb some of the energy from an explosion thereby protecting a seated occupant.

FIGS. 1 to 4 also show that there are two supporting arms 126*a*,126*b* onto which a seating area for an occupant may be placed.

The gas-sprung piston 124 is attached to a base, generally designated 128, comprising five legs 130,132,134,136,138. Each of the legs 130,132,134,136,138 are attached to castor wheels 130*a*,132*a*,134*a*,136*a*,138*a* respectively. The castor wheels 130*a*,132*a*,134*a*,136*a*,138*a* comprise a locking mechanism to prevent a user from turning a chair face-on to a glass area such as an outer structure of a building. The locking mechanism comprises a pin mechanism (not shown) which restricts the movement of the castor wheels 130*a*,132*a*,134*a*,136*a*,138*a*. The locking mechanism therefore prevents a user inadvertently turning a chair towards a glass containing area which will reduce the effectiveness of the chair.

Figure 2:
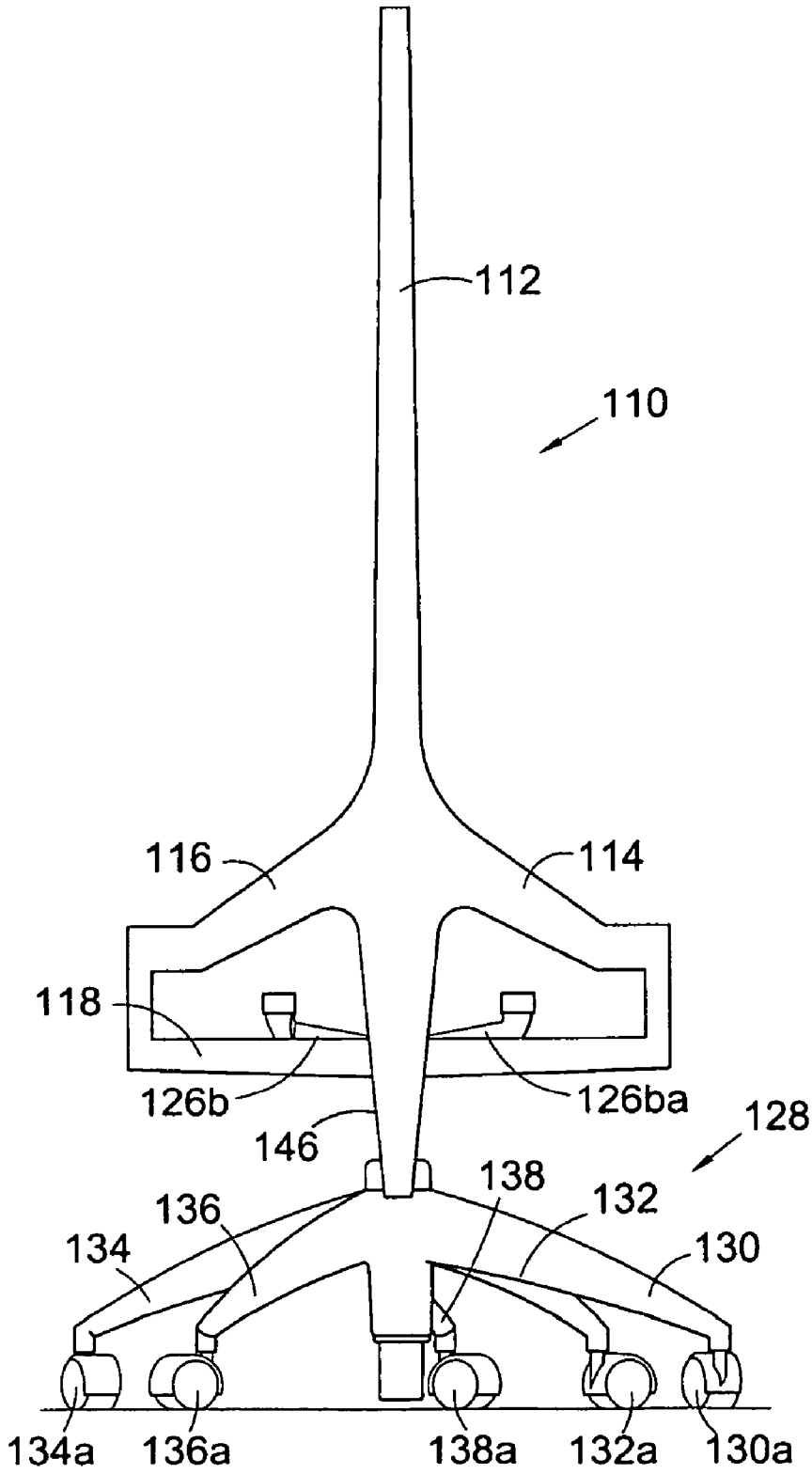
FIG. 2 is a rear view of the frame shown in FIG. 1.
Figure 3:
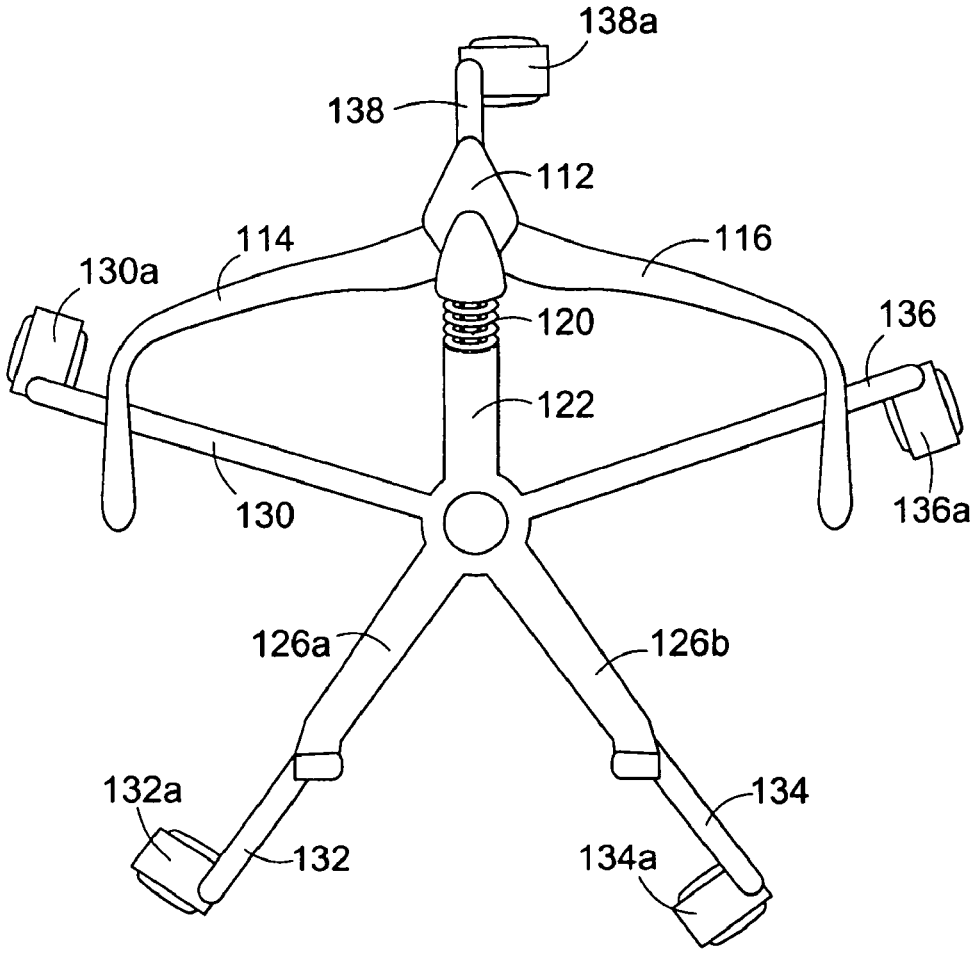
FIG. 3 is a top view of the frame shown in FIGS. 1 and 2.

FIG. 2 which is a rear view of the frame 110 shows that the spine 112 comprises a tail section 146 which will intercept glass shards and debris. The tail section 146 provides additional protection for an occupant's legs.

Figure 4:
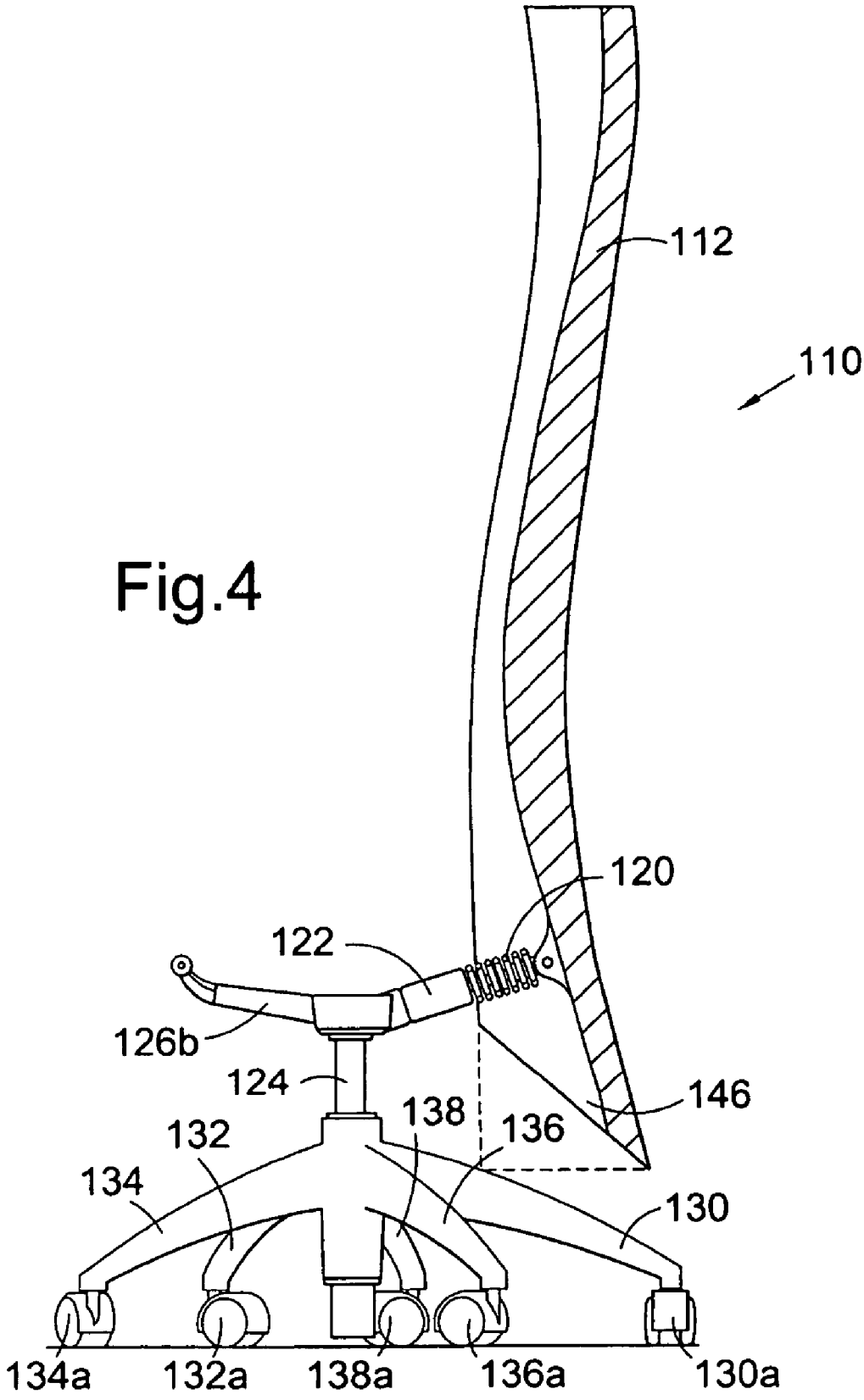
FIG. 4 is a part sectional side view of the frame shown in FIGS. 1 to 3.

The shape of the spine 112, as shown in FIG. 4, is curved and is specifically adapted to reduce blast pressures acting on a back of a chair.

The spine 112 is made from any suitable strong material such as steel which will protect an occupant of a chair in the event of an explosion such as a bomb blast.

Figure 5:
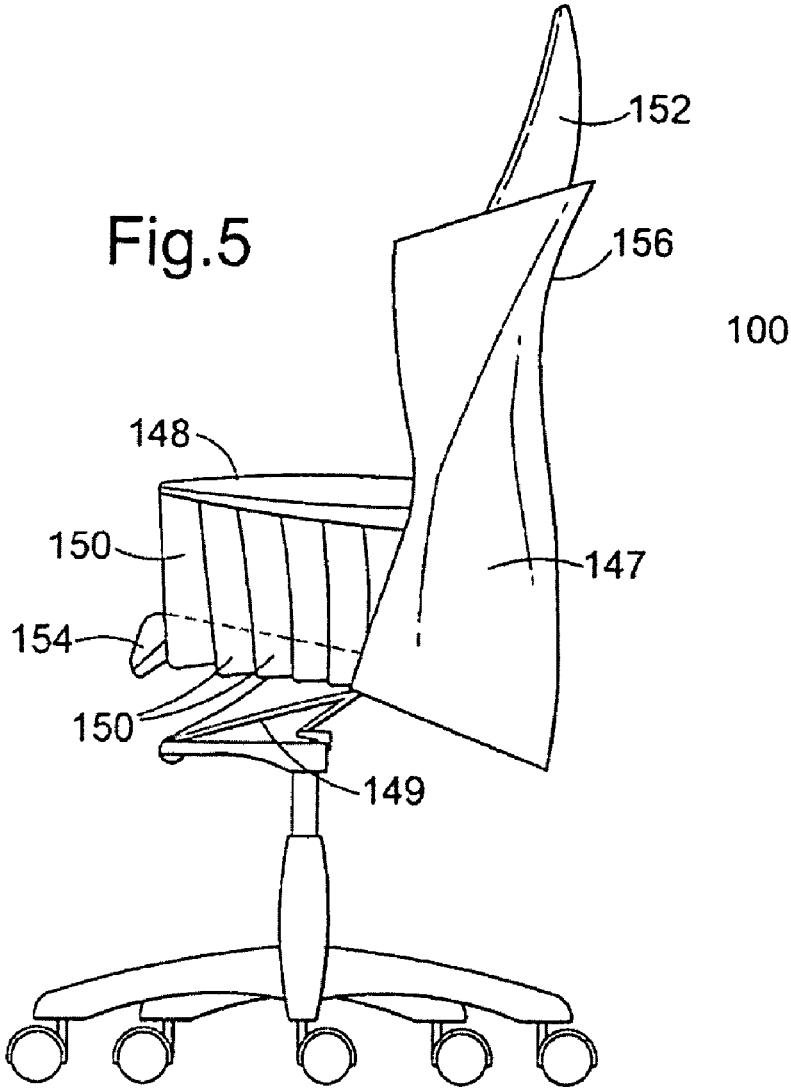
FIG. 5 is a side view of a chair according to a second embodiment of the present invention.

FIG. 5 represents a chair 100 according to the present invention. The chair 100 comprises a back 147 in the form of a shell. Located within the back 147 of the chair 100 there is a central spine 112 as shown in FIGS. 1 to 4. The back 147 extends around the side of the chair 100 providing protection to the side of an occupant. The central spine 112 extends along the length of the back 147. The chair 100 also comprises armrests 148 which are attached to interlocking fin sections 150. The fin sections 150 are intended to provide further protection to the lower body and legs of an occupant of the chair 100. The chair 100 also comprises a headrest 152 capable of protecting the head of an occupant. The chair 100 in FIG. 5 comprises a leaf-spring 149 providing added comfort to an occupant and capable of absorbing some of the energy from an explosion.

Figure 6:
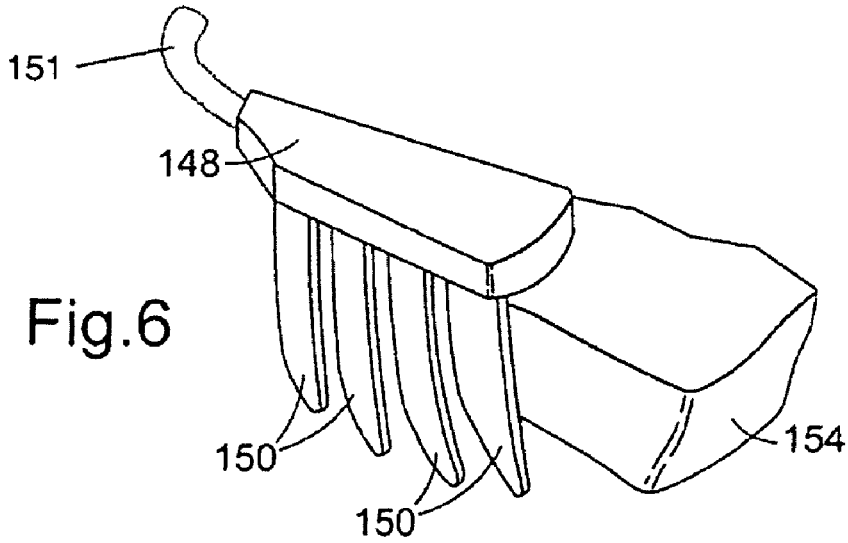
FIG. 6 is an expanded view of an armrest and fins of the chair as shown in FIG. 5.

FIG. 6 is an expanded view of the armrest 148 and seat 154 shown in FIG. 5. The armrest 148 has downwardly extending fins 150 which are intended to prevent debris and fragments damaging an occupant's lower body and legs. The fins 150 interlock with one another thereby providing a continuous barrier to fragments and debris but also providing ventilation to an occupant. The fins 150 are formed from strong composite material such as Kevlar(Trade Mark). The armrests 148 are capable of being pivoted into an occupant to provide further protection by preventing an occupant from sliding from the chair 100 in an event of a bomb blast. The armrests 148 may therefore gently abut against an occupant's sides.

Figure 7:
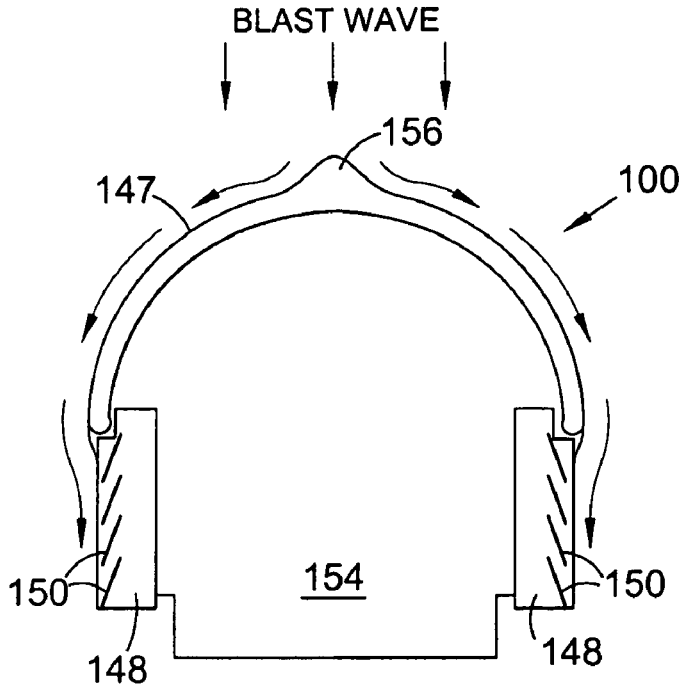
FIG. 7 is a sectional plan view of the chair shown in FIG. 5 illustrating blast pressure from a bomb blast.

FIG. 7 represents a sectional planar view of the chair 100 shown in FIG. 5. FIG. 7 shows that the back 147 of the chair 100 provides a substantially convex shape to an oncoming blast wave. A ridge 156 extending down the back 147 of the chair 100 has the function of splitting the over-pressure formed from an explosion and facilitating reduction of blast pressures. The ridge 156 extends fully down the back 147 of the chair 100 and protrudes by about 3 cm in a substantially 'V'-shaped design. Furthermore, as shown in FIG. 7, the armrests 148 are encompassed substantially within the circular perimeter of the back 147 of the chair 100 thereby providing further protection to an occupant, particularly the side.

Figure 8:
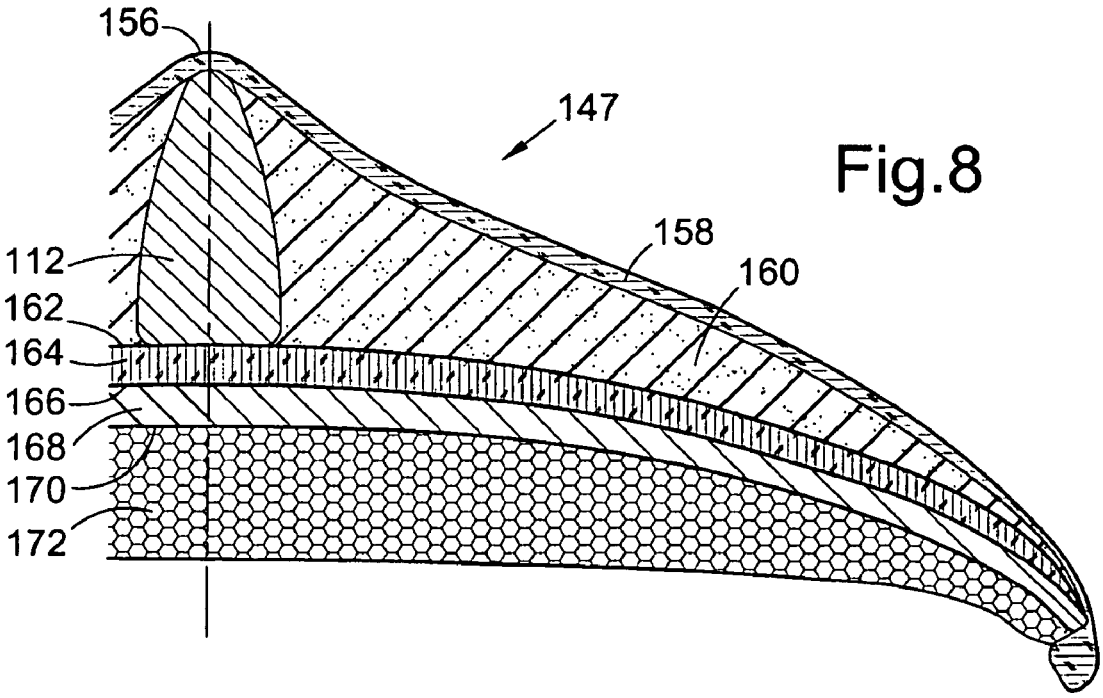
FIG. 8 is a cross-sectional view of a back of the chair shown in FIG. 5.

FIG. 8 is a cross-sectional view of the back 147 of the chair 100. An outer surface 158 of the back 147 of the chair 100 is formed from a strong material which has some degree of deformability to thereby minimize debris or fragments ricocheting off the back 147 of the chair 100. The back 147 of the chair 100 is therefore formed from a material such as Kevlar (Trade Mark). Located within the back 147 of the chair 100, the spine 112 extends substantially vertically down the back 147. The spine 112 provides added strength to the area behind the ridge 156 which facilitates the splitting of a blast wave. Located in substantially the middle of the back 147, there is a foam region 160 which has the function of further collecting fragments and debris such as shrapnel created from a bomb blast. Fragments and debris may therefore lodge themselves in the foam region 160 thereby preventing these objects injuring an occupant. The foam region 160 is of about 10 centimeters in thickness. There is then a sandwich-type structure formed by alternating hard and soft layers 162,164,166,168,170. The alternating hard and soft layers 162,164,166,168,170 are formed from alternating layers of Kevlar(Trade Mark) and other materials such as polyurethane, Evlon(Trade Mark), latex rubber foam, viscoelastic foam, closed cell foam and fibre foam. The alternating hard/soft layers 162,164,166,168,170 provide an absorption zone which protects an occupant from shock effects that result from the blast wave. The alternating hard/soft layers 162,164,166,168,170 also provide a further layer of protection to fast travelling fragments, glass shards and debris. There is then a padding layer 172 which is provided for comfort for an occupant and further cushioning during an explosion. FIG. 8 also shows that the back 147 of the chair 100 extends partially around the side and is therefore designed to cocoon an occupant and enhance the provided protection.

Figure 9:
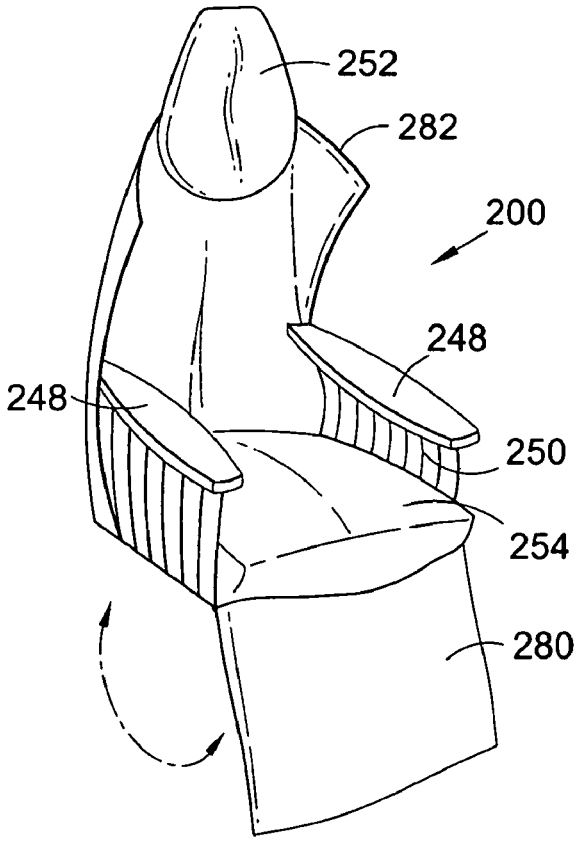
FIG. 9 is a perspective view of a chair according to a third embodiment of the present invention.

FIG. 9 represents a chair 200 comprising armrests 248, fins 250 depending from the armrests 248, a headrest 252 and a seat 254. Chair 200 comprises the additional protective feature of a leg protective member 280. The leg protective member is connected to a base of the seat 254. The leg protective member 280 is hinged and is therefore able to rotate like a cat flap. An occupant's legs may rest upon the leg protective member 280 and may therefore provide additional comfort. In the event of an explosion, the leg protective member 280 acts as a barrier against debris, glass shards and fragments and therefore provides protection to an occupant's legs. As the leg protective member 280 is hinged, the leg protective member 280 may rotate slightly upwards thereby dissipating at least part of the energy from a bomb blast. The leg protective member 280 is formed from strong material such as Kevlar (Trade Mark). The leg protective member also helps to prevent the chair 200 from overturning. The chair 200 also comprises side protecting members 282 made from Kevlar(Trade Mark) which further cocoon an occupant and provide added protection from an explosion occurring to either side.

Figure 10:
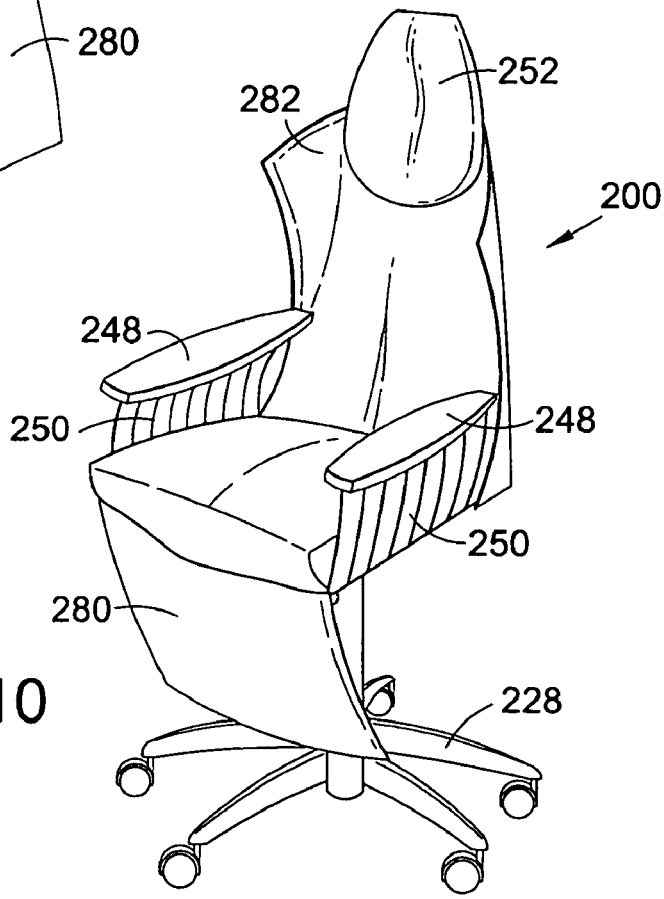
FIG. 10 is a perspective view of the chair shown in FIG. 9 attached to a base.
Figure 11:
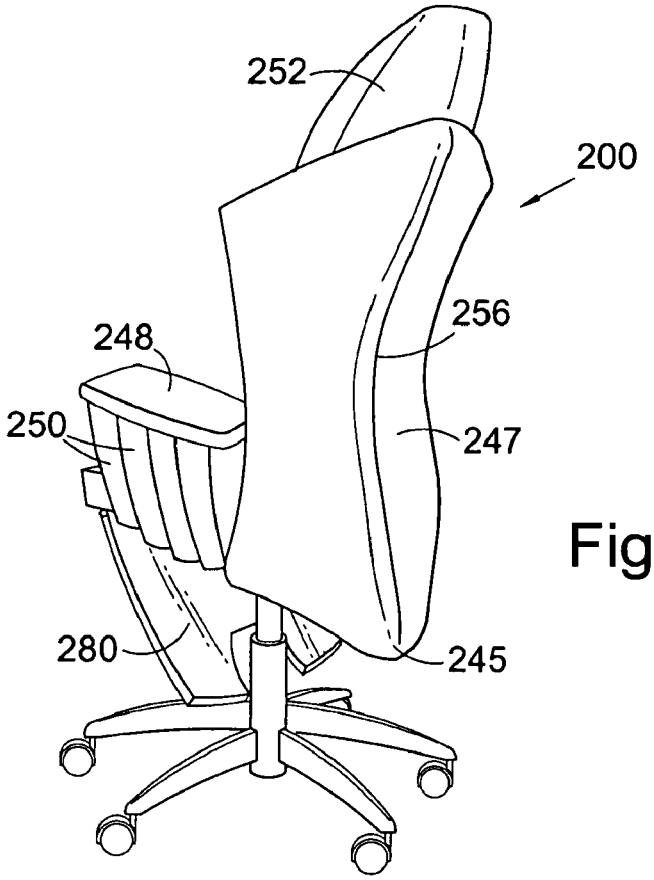
FIG. 11 is a side view of the chair shown in FIG. 10.
Figure 12:
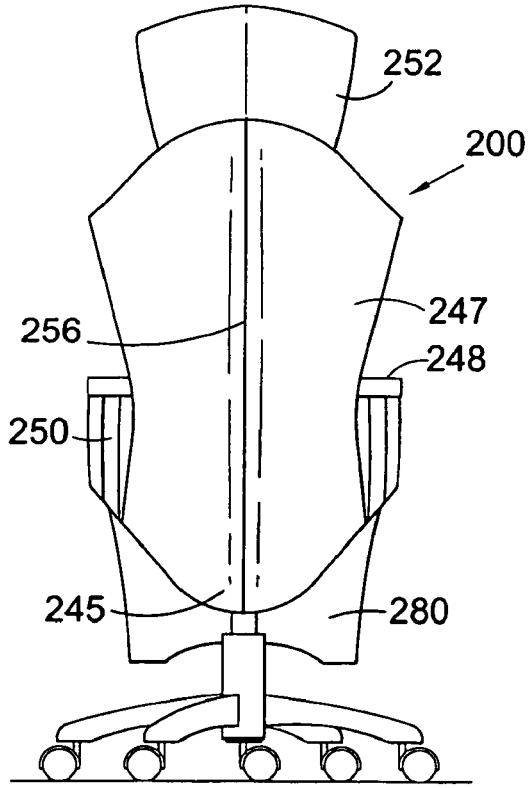
FIG. 12 is a rear view of the chair shown in FIGS. 10 and 11.

FIG. 10 shows the chair 200 shown in FIG. 9 attached to a base 228 upon which the chair 200 may be moved. FIGS. 11 and 12 provide additional views of the chair 200. FIGS. 11 and 12 clearly show that a protruding ridge 256 extends fully down the back 247 of the chair 200. The ridge 256 has the function of splitting the over-pressure formed from a bomb blast. FIGS. 11 and 12 also show that the back 247 comprises an extended protruding tail 245 which provides added protection to an occupant from fragments, glass shards and debris.

Figure 13:
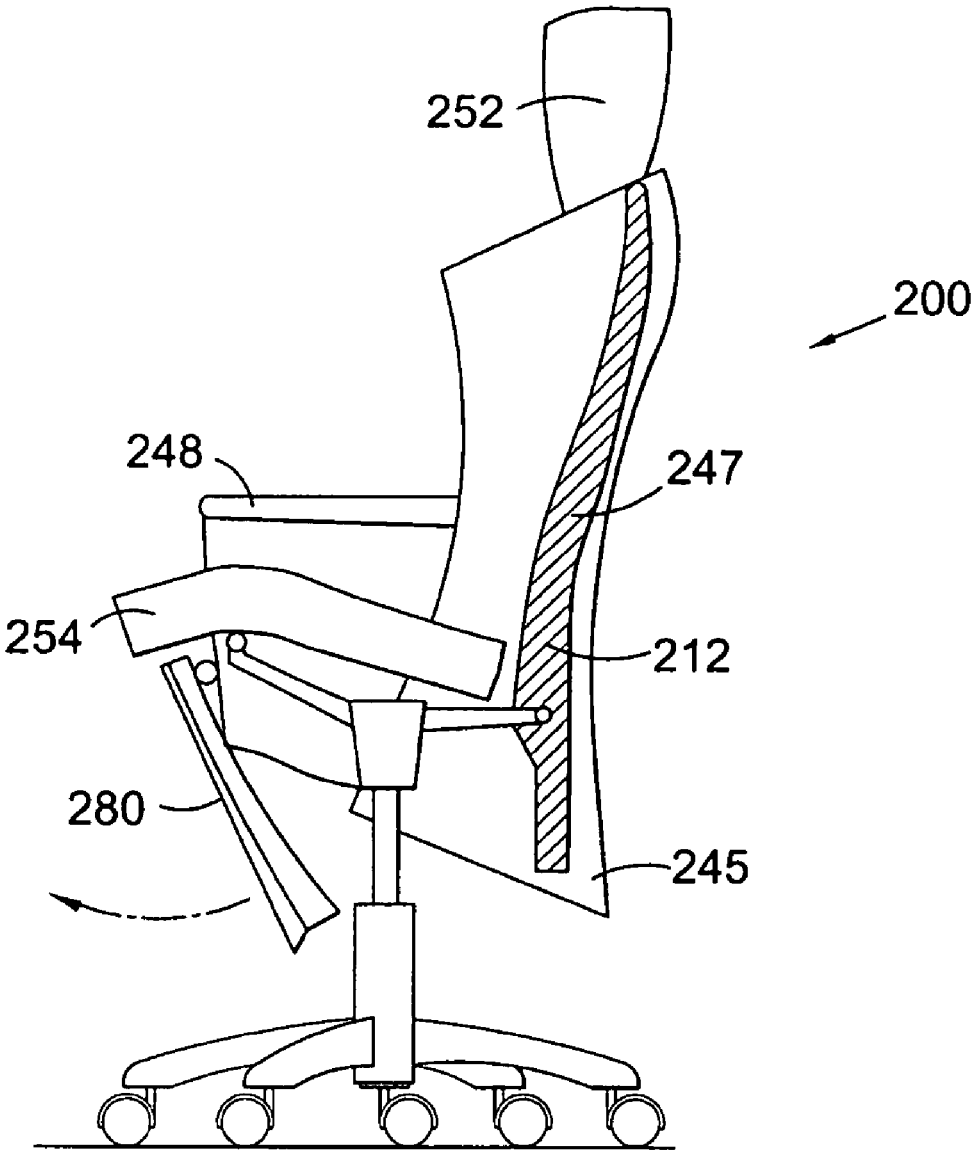
FIG. 13 is a side view of the chair shown in FIGS. 10 to 12 representing a leg protector in the form of a cat flap in operation.

FIG. 13 is a sectional side view of the chair 200 which illustrates the position of the spine 212 in the back 247 of the chair 200. The spine 212 extends fully down the back 247 providing protection to an occupant.

Figure 14A:
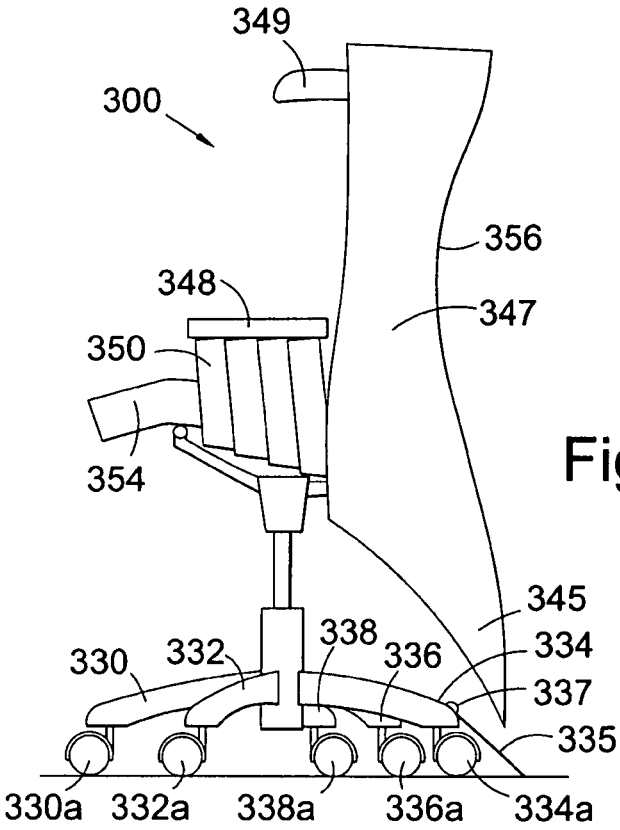
FIGS. 14*a* and 14*b* represent the operation of a chair according to a fourth embodiment of the present invention.
Figure 14B:
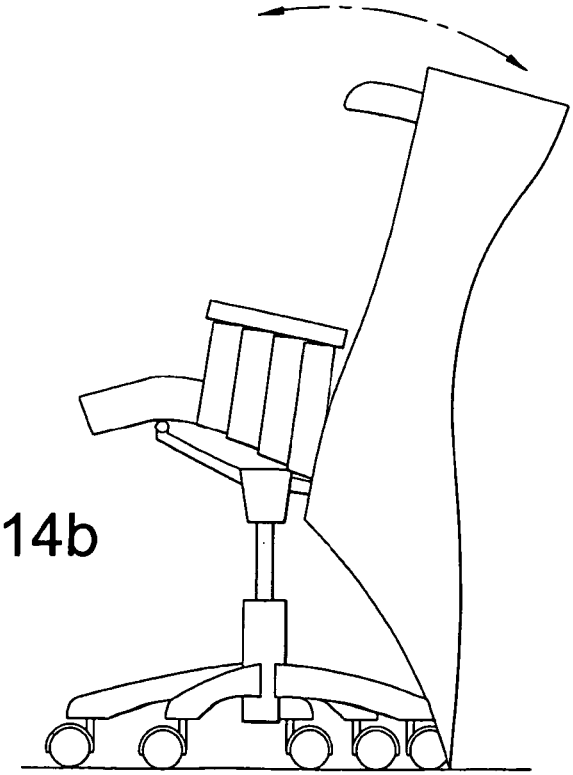

FIGS. 14*a* and 14*b* show a further chair 300 which comprises a back 347 with a central ridge 356. The chair 300 comprises a canopy 349 which provides protection to an occupant from falling projectiles and glass shards. In contrast to chair 200, the chair 300 does not comprise a leg protective member. FIG. 14*b* shows the chair 300 under the influence of pressure whereupon a protruding tail 345 engaging with a floor, provides additional protection from fragments, shards and debris. The chair 300 comprises legs 330,332,334,336,338 attached to castors 330*a*,332*a*,334*a*,336*a*,338*a*, respectively. Leg 334 comprises an eyelet 337 through which a tie line 335 is inserted. The leg 334 is therefore fixed to the floor thereby preventing the chair 300 being moved horizontally or rotating in the event of an explosion such as a bomb blast.

Figure 15A:
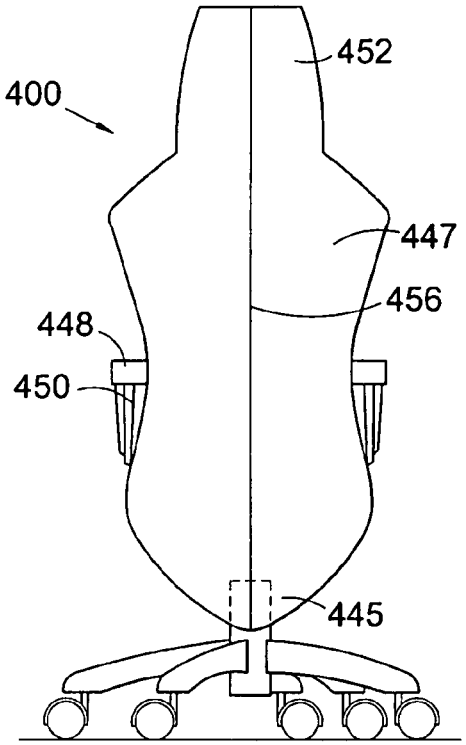
FIGS. 15*a* and 15*b* represent rear and side views of a chair according to a fifth embodiment of the present invention.
Figure 15B:
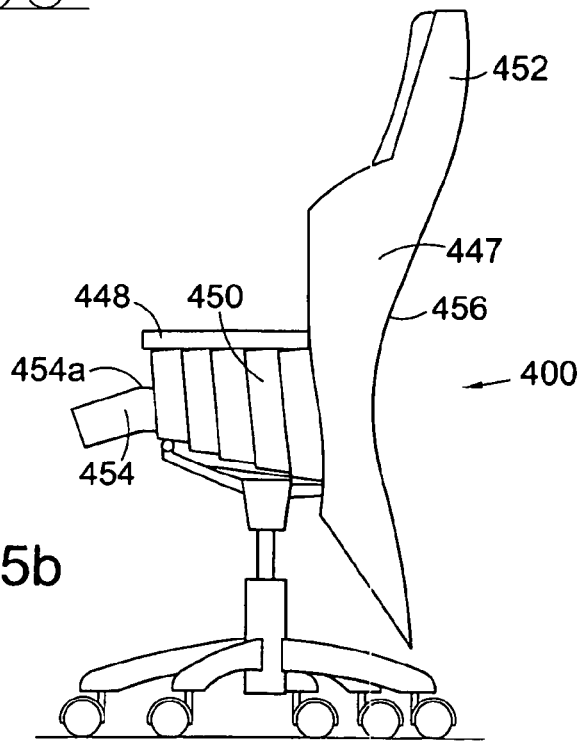

FIGS. 15*a* and 15*b* represent a chair 400 comprising a headrest 452 which is integral with the rest of a back 447 of the chair 400. The back 447 and headrest 452 of the chair 400 are therefore in the form of a monologue which provides additional protection to an occupant. The chair 400 comprises armrests 448 and fins 450 protecting the lower body and legs of an occupant. A protruding ridge 456 extends fully down the back 447 and headrest 452 of the chair 400. The seat 454 of chair 400 comprises a raised portion 454*a* which prevents an occupant from being unseated in the event of an explosion. Although not shown, the armrests 448 comprise airbags which activate in the event of an explosion and provide additional protection to an occupant.

Figure 16A:
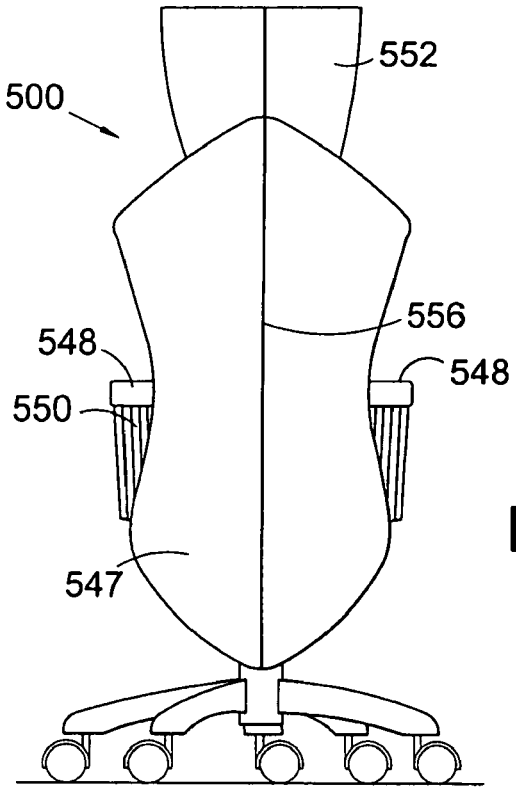
FIGS. 16*a* and 16*b* represent rear and side views of a chair according to a sixth embodiment of the present invention.
Figure 16B:
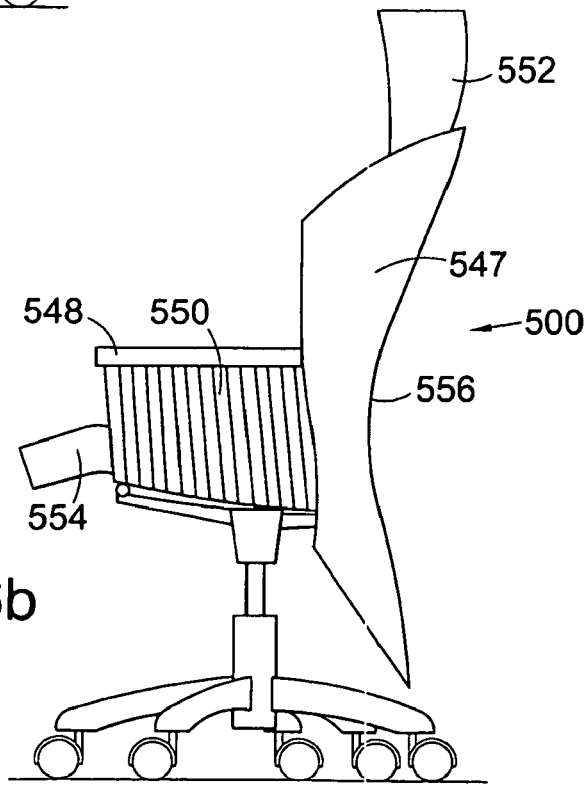

FIGS. 16*a* and 16*b* show a further chair 500 which comprises a separate headrest 552 which is attached to a back 547 of the chair 500. The back 547 forms a shoulder height back monologue for an occupant. A ridge 556 splits a blast wave as previously discussed with fins 550 depending from armrest 548 providing additional protection to an occupant.

Figure 17A:
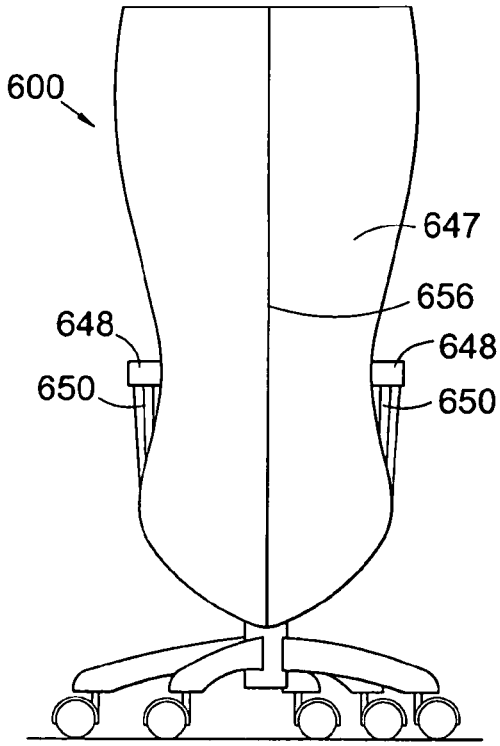
FIGS. 17*a* and 17*b* represent rear and side views of a chair according to a seventh embodiment of the present invention.
Figure 17B:
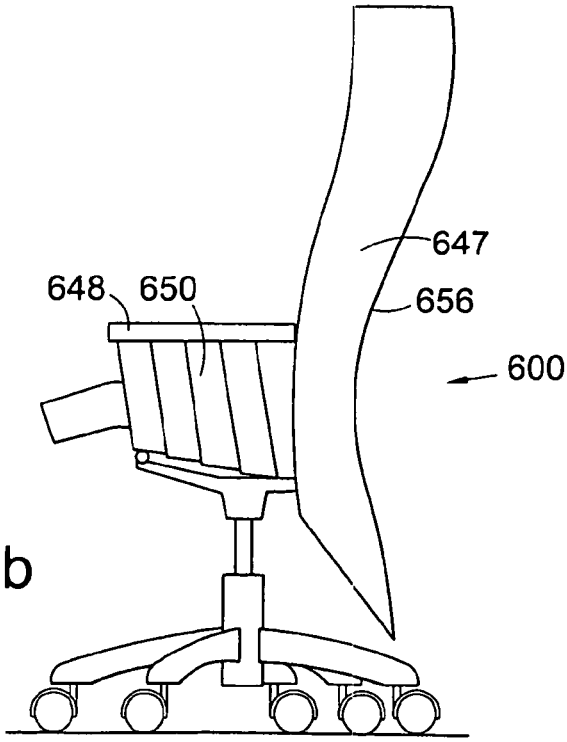

FIGS. 17*a* and 17*b* represent a high back 'executive' style monologue chair 600. The chair 600 comprises armrests 648 and protective fins 650. Extending down a back 647 of the chair 600, there is a ridge 656 which has the function of splitting the bomb blast formed by a bomb blast away and reduce blast pressures acting on the chair 600.

Figure 18A:
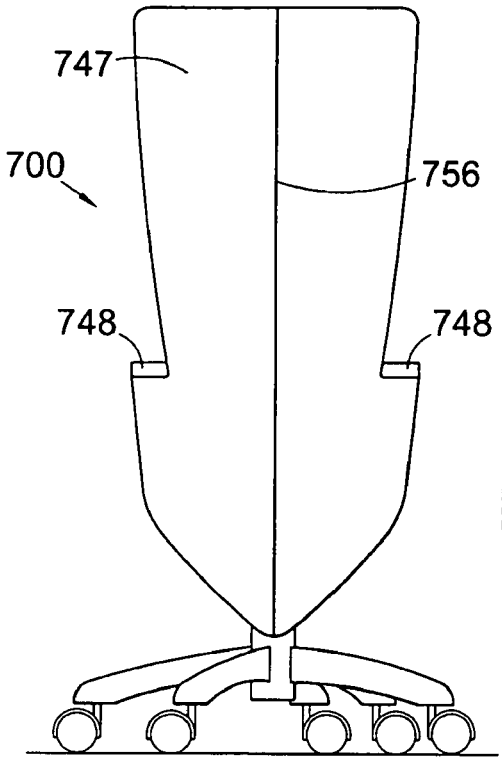
FIGS. 18*a* and 18*b* represent rear and side views of a chair according to an eighth embodiment of the present invention.
Figure 18B:
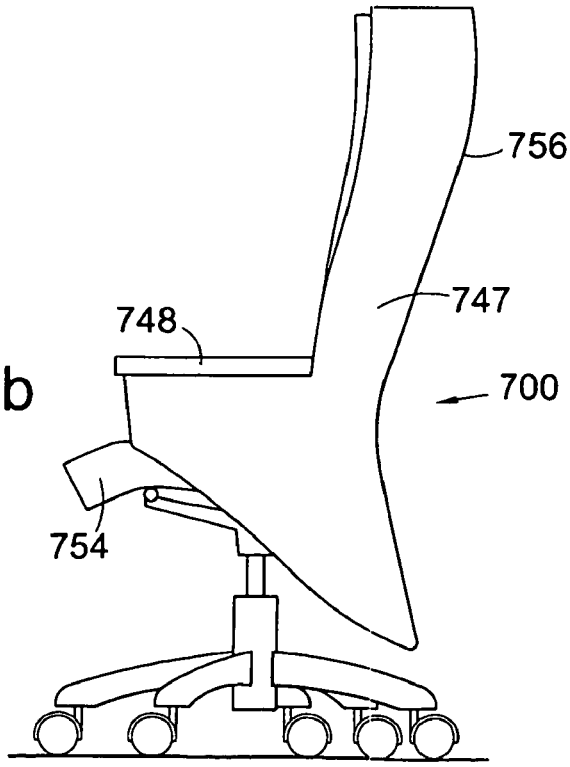

FIGS. 18*a* and 18*b* represent a high back 'executive' style chair 600 which comprises armrest sections 748 which are integral with a back 747 of the chair 700. The back and sides of the chair 600 are therefore of a monologue construction. An occupant may therefore sit in the chair 700 with their legs protected by the side members of the monologue construction. As before, a ridge 756 extends down the back 747 of the chair 700 providing protection to an occupant.

Figure 19A:
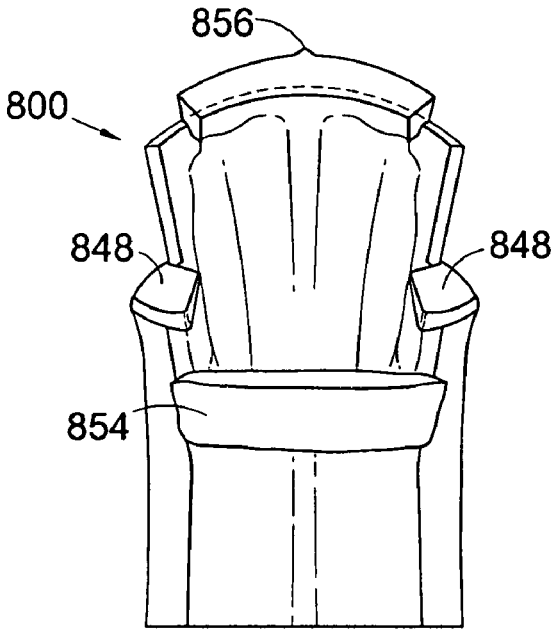
FIGS. 19*a*-19*c* represent a chair according to a ninth embodiment of the present invention.
Figure 19B:
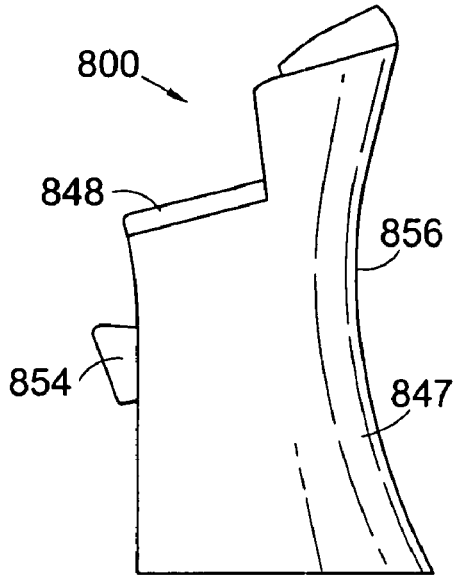
Figure 19C:
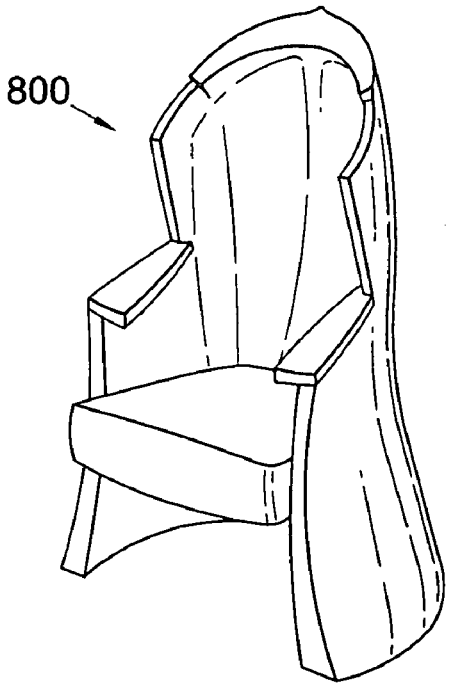

FIGS. 19*a*, 19*b* and 19*c* represent a tub chair 800. The chair 800 is of a monocoque construction wherein the back 847 extends around the side of the chair 800 providing protection to an occupant's legs and sides. Armrests 848 are therefore integrally formed with the back 847. A ridge 856 extends fully down the back 847 of the chair 800 providing the function of splitting a blast wave formed by a bomb blast.

Figure 20A:
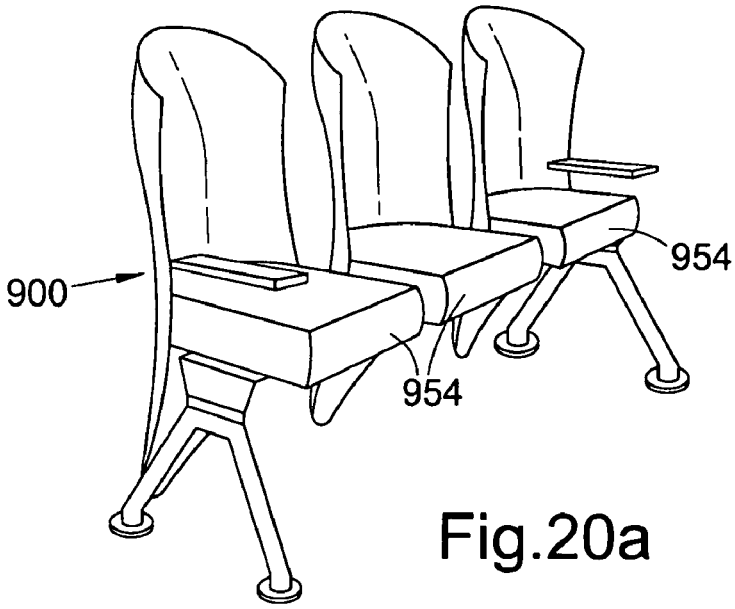
FIGS. 20*a*-20*c* represent a chair according to a tenth embodiment of the present invention.
Figure 20B:
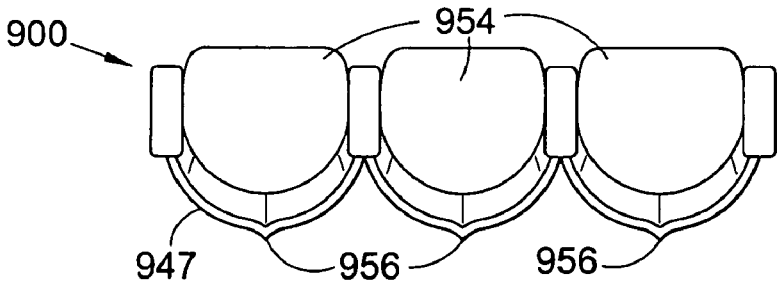
Figure 20C:
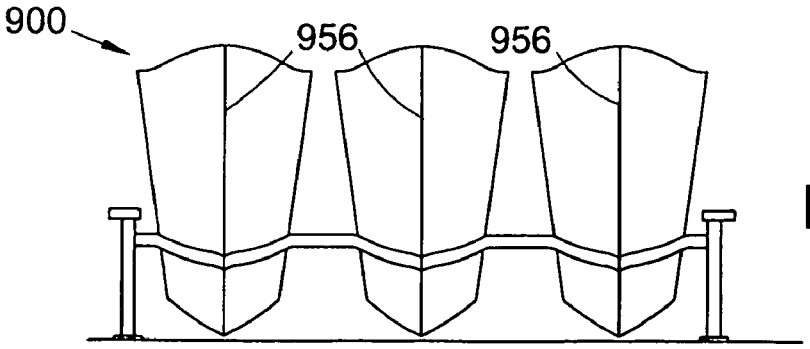

FIGS. 20*a*, 20*b* and 20*c* represent a series of chairs, generally designated 900. Each of the chairs comprises a ridge 956 extending fully down the back 946 of the chairs. The ridge 956 has a function of splitting the pressure formed by a bomb blast. Each of the chairs has a seat 954 where an occupant may sit and have the facility of being provided with protection from an explosion such as a bomb blast occurring substantially behind.

Whilst specific embodiments of the invention have been described above, it will be appreciated that departure from the described embodiments may still fall within the scope of the invention. For example, any form of ridge extending down a back of a chair which has the ability to split the pressure from an explosion may be used. Additionally, a back or side of the chair may be of any suitable structural form which has the ability to protect an occupant from debris and fragments. Any combination of foam and sandwich-type structures may be used to form the back or side of the chair. The back of the chair may also be formed integrally with a headrest or armrest which extends around an occupant providing a protective cocoon. The back of the chair may be of any suitable curved or substantially convex shape which minimizes blast pressure acting on the chair.

The invention claimed is:

1. An office chair adapted to provide protection for an occupant in an event of an explosion, the office chair comprising:

a seat portion;

a back portion comprising cushioning adapted for contact with a back of an occupant for reducing transmission of shock from the back portion to the occupant and a rigid shard-intercepting shell extending upwards from and at least partially around sides of the seat portion and including material selected and configured to protect a head and body of the occupant from glass shards;

a base portion adapted to support the seat portion and the back portion and comprising casters for permitting movement of the chair across a supporting floor;

armrests and a plurality of members extending downwards from the armrests adapted to provide protection to a lower body and upper legs of the occupant, wherein the plurality of members extending from the armrests are spaced-apart fins, edges of adjacent fins overlapping.

2. An office chair adapted to provide protection for an occupant in an event of an explosion, the office chair comprising:

a seat portion;

a back portion comprising cushioning adapted for contact with a back of an occupant for reducing transmission of shock from the back portion to the occupant and a rigid shard-intercepting shell extending upwards from and at least partially around sides of the seat portion and including material selected and configured to protect a head and body of the occupant from glass shards, wherein the back portion includes a sandwich-type structure having a hard layer and a soft layer that alternate, providing multiple hard layers; and a base portion adapted to support the seat portion and the back portion and comprising casters for permitting movement of the chair across a supporting floor.

3. An office chair adapted to provide protection for an occupant in an event of an explosion, the office chair comprising:

a seat portion;

a back portion comprising cushioning adapted for contact with a back of an occupant for reducing transmission of shock from the back portion to the occupant and a rigid shard-intercepting shell extending upwards from and at least partially around sides of the seat portion and including material selected and configured to protect a head and body of the occupant from glass shards, wherein between the shell and the cushioning, the back portion includes energy absorbing foam located behind the shell, then a sandwich-type structure having a hard layer and a soft layer that alternate, and multiple hard layers located inwardly of the energy absorbing foam; and a base portion adapted to support the seat portion and the back portion and comprising casters for permitting movement of the chair across a supporting floor.

4. An office chair adapted to provide protection for an occupant in an event of an explosion, the office chair comprising:

a seat portion;

a back portion comprising cushioning adapted for contact with a back of an occupant for reducing transmission of shock from the back portion to the occupant and a rigid shard-intercepting shell extending upwards from and at least partially around sides of the seat portion and including material selected and configured to protect a head and body of the occupant from glass shards, wherein the back portion includes a tail which extends below the seat portion to protect lower legs of the occupant against glass shards; and a base portion adapted to support the seat portion and the back portion and comprising casters for permitting movement of the chair across a supporting floor.

5. An office chair adapted to provide protection for an occupant in an event of an explosion, the office chair comprising:

a seat portion;

a back portion including:

a rigid shard-intercepting shell extending upwards from and at least partially around sides of the seat portion and including material selected and configured to protect a head and a body of an occupant from glass shards, energy absorbing foam located inwardly of the shell, a sandwich-type structure having a hard layer and a soft layer that alternate and including multiple hard layers, and cushioning adapted for contact with a back of the occupant for reducing transmission of shock from the back portion to the occupant; and a base portion being adapted to support the seat portion and the back portion on a supporting floor and including casters for permitting movement of the office chair across the supporting floor.

* * * * *